United States Patent [19]

Heitkamp et al.

[11] 4,095,436

[45] Jun. 20, 1978

[54] METHOD OF, AND APPARATUS FOR, CONTROLLING THE ADVANCE OF A TUNNEL DRIVE SHIELD

[75] Inventors: Herbert Heitkamp, Werne; Rolf Stoltz, Bottrop, both of Germany

[73] Assignee: Gewerkschaft Eisenhutte Westfalia, Lunen, Germany

[21] Appl. No.: 779,851

[22] Filed: Mar. 21, 1977

[30] Foreign Application Priority Data

Mar. 23, 1976 Germany ..... 2612169

[51] Int. Cl.[2] ..... E01G 3/00

[52] U.S. Cl. ..... 61/85; 91/170 R

[58] Field of Search ..... 61/85, 84; 299/31, 11; 91/170 R

[56] References Cited

U.S. PATENT DOCUMENTS

| | | | |
|---|---|---|---|
| 3,581,507 | 6/1971 | Stevens | 61/85 |
| 3,733,835 | 5/1973 | Jacobs | 61/85 |
| 3,818,713 | 6/1974 | Lobbe | 61/85 |
| 3,889,479 | 6/1975 | Trott | 61/85 |

*Primary Examiner*—Jacob Shapiro

*Attorney, Agent, or Firm*—Sughrue, Rothwell, Mion, Zinn and Macpeak

[57] ABSTRACT

Apparatus is provided for controlling the advance of a tunnel drive shield. The drive shield is of the type having a plurality of elongate implements (or planks) which are supported and guided on a frame. Hydraulic rams are provided for moving the planks relative to the frame. The control apparatus comprises hydraulic ram means, which act between the frame and the permanent tunnel lining, and means for varying the pressure of hydraulic fluid applied to said hydraulic ram means. The frame can be advanced by applying hydraulic fluid to said hydraulic ram means and by simultaneously applying hydraulic fluid to at least one of said hydraulic rams. The direction of frame advance is controlled by varying the ratio of the pressures of the hydraulic fluid applied to said hydraulic ram means and to said at least one hydraulic ram.

22 Claims, 3 Drawing Figures

METHOD OF, AND APPARATUS FOR, CONTROLLING THE ADVANCE OF A TUNNEL DRIVE SHIELD

BACKGROUND OF THE INVENTION

This invention relates to a method of, and apparatus for, controlling the advance of a tunnel drive shield, and to a drive shield incorporating such apparatus. The term "tunnel" or "tunnels"]used throughout this specification and claims is intended to include galleries, trenches, adits or other similar elongated excavations.

It is known to use drive shields for excavating tunnels in ground having widely varying properties. When the ground being excavated is rock, tunnels are driven with the help of a special rock breaking device. However, even rocky ground is by no means of uniform consistency as it is often interlayered with sandy ground so that there always exists the danger that, unless the walls of the excavation are immediately supported, they will cave-in. Consequently, it is important to support tunnel walls immediately after they have been excavated.

One known drive shield which does just this is a knife shield, that is to say a shield of the type having a plurality of elongate implements (or planks), each of which is supported and guided on a frame. The planks are movable relative to the frame by means of hydraulic rams. Thus, immediately a tunnel is excavated, the planks can be moved up, either singly or in groups, to support the walls of the tunnel.

A disadvantage of this type of shield is that the known methods of advancing it in a predetermined direction rely on a large contact area between the shield and the tunnel walls. This is because the large forces which are necessary to advance the shield have to be taken up entirely by the frictional force between the shield and the tunnel wall. Where the ground being excavated is rock intercalated with sand, adquate contact between the shield and the tunnel walls will not always exist.

SUMMARY OF THE INVENTION

The present invention provides a method of controlling the advance of a tunnel drive shield of the type having a plurality of elongate implements each of which is supported and guided on a frame, the elongate implements being movable relative to the frame by means of hydraulic rams, the method comprising the step of advancing the frame by applying hydraulic fluid to hydraulic ram means acting between the frame and a fixed tunnel lining positioned behind the drive shield, and by simultaneously applying hydraulic fluid to at least one of said hydraulic rams whereby the direction of advance of the frame is controllable by varying the ratio of the pressures of the hydraulic fluid applied to said hydraulic ram means and to said at least one hydraulic ram.

Prior to the advance of the frame, the elongate implements may be advanced by said hydraulic rams. In this case, it is preferable if, after the advance of the elongate implements but prior to the advance of the frame, each of said at least one hydraulic ram is braced outwardly into firm contact with the tunnel wall.

This method of controlling the advance of a drive shield enables the drive shield to be used much more widely, and in particular in ground which is rock intercalated with sand. This is because the reaction forces resulting from the frame advance are taken up mainly by the already laid permanent tunnel lining.

The invention also provides apparatus for controlling the advance of a tunnel drive shield of the type having a plurality of elongate implements each of which is supported and guided on a frame, the elongate implements being movable relative to the frame by means of hydraulic rams, the apparatus comprising hydraulic ram means acting, in use, between the frame and a fixed tunnel lining positioned behind the drive shield, and means for varying the pressure of hydraulic fluid applied to said hydraulic ram means whereby the frame can be advanced by applying hydraulic fluid to said hydraulic ram means and by simultaneously applying hydraulic fluid to at least one of said hydraulic rams, the apparatus being such that the direction of advance of the frame is controllable by varying the ratio of the pressures of the hydraulic fluid applied to said hydraulic ram means and to said at least one hydraulic ram.

Advantageously, a first control unit constitutes the means for varying the pressure of hydraulic fluid applied to said hydraulic ram means.

Said hydraulic ram means may be constituted by a plurality of hydraulic rams each of which may be provided with a pressure relief valve whereby the hydraulic fluid may be applied to each of said rams at a different pressure. In this case, the first control unit may be provided with a respective pressure regulating valve for each of the hydraulic rams constituting said hydraulic ram means, the pressure-regulating valves being pre-set so as to apply hydraulic fluid at the same pressure to each of the pressure-relief valves associated with said hydraulic rams of said hydraulic ram means.

Preferably, a second control unit controls the pressure of hydraulic fluid applied to each of said at least one hydraulic ram, the second control unit being such that a constant pressure is applied to said at least one hydraulic ram. Advantageously, this is effected by providing the second control unit with a pressure-regulating valve pre-set to apply the same pressure to each of said at least one hydraulic ram.

The invention further provides a drive shield comprising a plurality of elongate implements each of which is supported and guided on a frame, the elongate implements being movable relative to the frame by means of hydraulic rams, and apparatus for controlling the advance of the shield, said apparatus being as defined above, said hydraulic ram means acting, in use, between the frame and a fixed tunnel lining positioned behind the shield.

Advantageously, said hydraulic ram means is positioned at the bottom of the shield.

The second control unit may control the pressure of hydraulic fluid applied to a group of said hydraulic rams, said group being positioned at the top of the shield. Preferably, however, there are two second control units each of which controls the pressure of hydraulic fluid applied to a respective group of said hydraulic rams, said groups being positioned symmetrically about the longitudinal plane of symmetry of the shield and above the horizontal plane of symmetry of the shield.

Advantageously, each of the elongate implements is associated with a respective one of said hydraulic rams. In order to enable the drive shield to be used for excavations requiring the use of an overhead excavator, it is preferable if each elongate implement associated with each of said at least one hydraulic ram is provided with a device for bracing that elongate implement outwardly into firm contact with the tunnel wall.

Preferably, said hydraulic ram means acts between a floor pan which forms part of the frame and said tunnel lining. By using a floor tray, the drive shield may conveniently operate in water-logged ground.

BRIEF DESCRIPTION OF THE DRAWINGS

A drive shield constructed in accordance with the invention will now be described, by way of example, with reference to the accompanying drawings, in which.

DESCRIPTION OF PREFERRED EMBODIMENT

Figure 1:
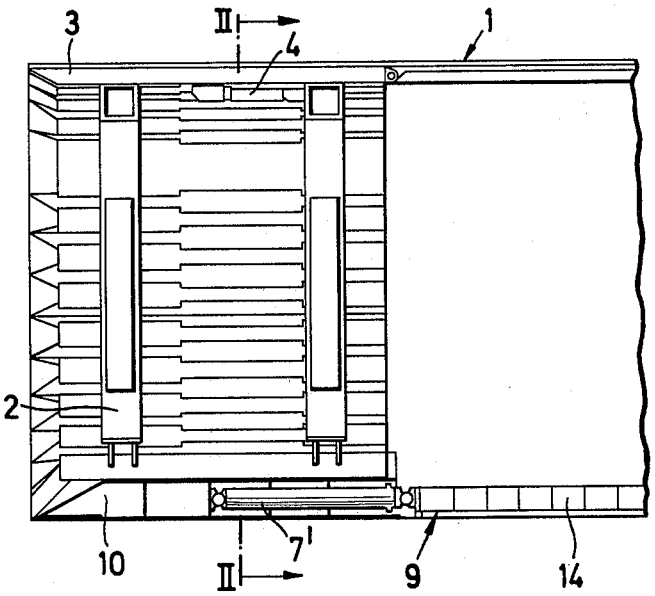
FIG. 1 is a diagrammatic longitudinal section through the shield.
Figure 2:
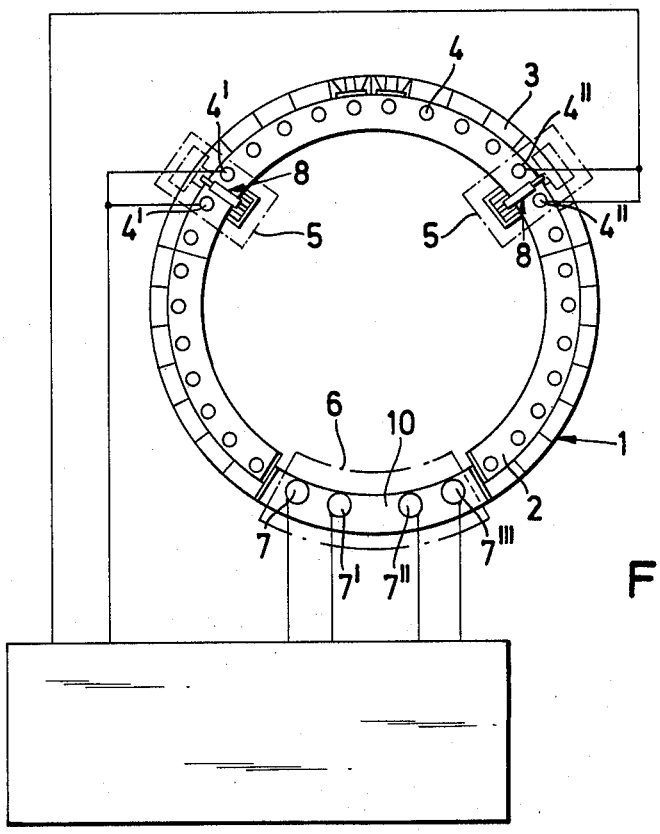
FIG. 2 is a diagrammatic transverse section through the shield.

Referring to the drawings, FIGS. 1 and 2 show a knife shield 1 for use in excavating tunnels. A plurality of planks 3 are supported and guided on a frame 2. The planks 3 are arranged side-by-side so as to define a complete shield. Each plank has a cutting portion (not shown) at its forward end. Each of the planks 3 is associated with a double-acting hydraulic ram 4 disposed between the frame 2 and the plank in question. A floor tray 10, which is fixed to the frame 2, is provided at the bottom of the shield 1. Four double-acting hydraulic rams 7, 7', 7'', and 7''' are disposed between the floor tray 10 and one of the tubbing rings 14 which constitute a permanent tunnel lining 9 immediately behind the shield 1.

The advance movement of the shield 1 is controlled by means of two control units 5 and a control unit 6. The control unit 6 is associated with the four rams 7, 7', 7'' and 7''' and the two control units 5 are each associated with two of the rams 4, these rams being denoted by the reference numerals 4' for a first of the units and 4'' for the other unit. The two units 5 are positioned in the top half of the shield 1 and are arranged symmetrically with respect to the longitudinal axis of symmetry of the shield. The rams 4' are hydraulically coupled together to constitute a double-ram. Similarly, the rams 4'' are coupled together hydraulically. The planks 3 associated with each pair of rams 4' and 4'' are provided with a device 8, such as a hydraulic ram, for bracing these planks outwardly so as to grip the tunnel wall firmly.

Figure 3:
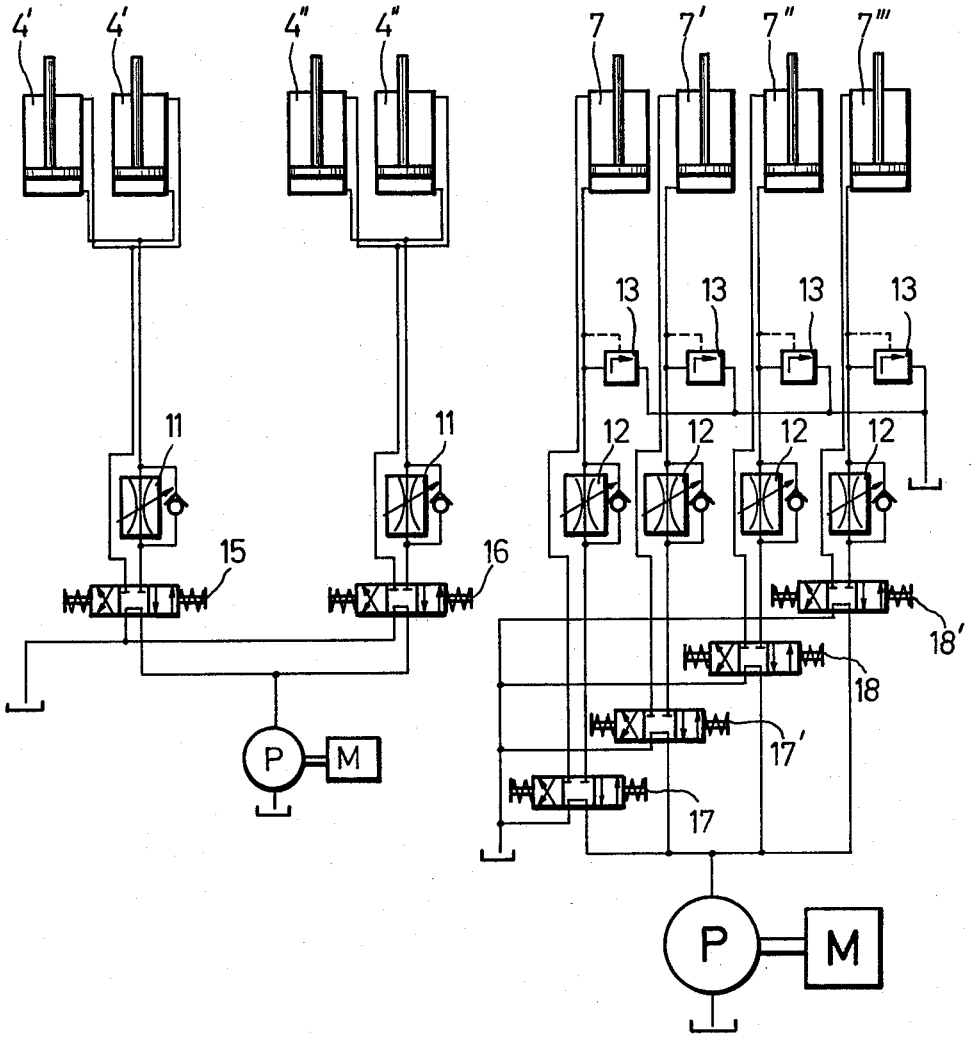
FIG. 3 is a circuit diagram of the hydraulic control means for the shield.

FIG. 3 shows the hydraulic circuits associated with the control units 5 and 6. The circuit associated with the control units 5 is supplied with hydraulic fluid by means of a pump P powered by a motor M. Similarly, the circuit associated with the control unit 6 is supplied with hydraulic fluid by means of a pump P' powered by a motor M'. Downstream of the pump P, the fluid supply lines leading to the two control units 5 are each provided with a multi-way valve 15 and 16 and a pressure-regulating valve 11. Similarly, each of the supply lines leading from the pump P' to the rams 7, 7', 7'' and 7''' is provided with a multi-way valve 17, 17' 18 and 18' respectively and with a respective pressure-regulating valve 12. The lines leading from these pressure-regulating valves 12 are each provided with a respective pressure-relief valve 13.

Control of the advance movement of the shield 1 is effected by controlling the advance movement of the frame 2, this advancing of the frame taking place after all the planks 3 have been advanced (either singly or in groups) by extending the rams 4. The control units 5 and 6 control this frame advance as follows. In order to control the movement of the frame 2 in the vertical plane (that is to say to move it up or down), it is necessary to change the spatial position of the frame. This is done, if necessary after bracing the planks 3 associated with the pairs of rams 4' and 4'' outwardly by means of the devices 8, by applying hydraulic fluid to the rams 4' and 4'' so as to retract them. This requires changing the positions of the multi-way valves 15 and 16 so that hydraulic fluid is applied to the opposite end of each of these rams to that to which fluid was applied to extend that ram. Similtaneously, the multi-way valves 17, 17' 18 and 18' are operated so that the rams 7, 7', 7'', and 7''' are expanded. The rams 4' and 4'' are all supplied with hydraulic fluid at a constant pressure by the pressure-regulating valves 11 of the control units 5, whereas the rams 7, 7', 7'' and 7''' are supplied with hydraulic fluid at a slightly different pressure by the pressure-regulating valves 12 of the control unit 6. Thus, by regulating the pressure of the hydraulic fluid applied to the rams 7, 7', 7'' and 7''' the working strokes of these rams can be varied and so the direction of advance of the frame 2 in the vertical plane can be controlled (the working strokes of the rams 4' and 4'' being constant).

In order to drive the shield 1 to the right during its advance movement, the pressure relief valves 13 are adjusted so that the pressure of hydraulic fluid reaching the rams 7'' and 7''' is greater than that reaching the rams 7 and 7'. Similarly, for driving the shields 1 to the left, the rams 7 and 7' are supplied with hydraulic fluid at a greater pressure than the rams 7'' and 7'''. In some cases the two rams 7 and 7' or 7'' and 7''' may be totally relieved of pressurised hydraulic fluid.

Thus, by varying the pressure of hydraulic fluid applied to the rams 7, 7', 7'', and 7''', advance movement of the frame 2 in both vertical and horizontal directions can be controlled, which in turn means that the direction of shield advance is also controlled. Moreover, as the reaction forces caused by the retraction of the rams 4' and 4'' and by the expenasion of the rams 7, 7', 7'' and 7''' can, if necessary, all be taken up on the tunnel lining 9, this controlled advance movement is possible in ground such as rock intercalated with sand.

We claim:

1. A method of controlling the advance of a tunnel drive shield of the type having a plurality of elongate implements each of which is supported and guided on a frame, the elongate implements being movable relative to the frame by means of hydraulic rams, the method comprising the step of advancing the frame by applying hydraulic fluid to hydraulic ram means acting between the frame and a fixed tunnel lining positioned behind the drive shield, and by simultaneously applying hydraulic fluid to at least one of said hydraulic rams whereby the direction of advance of the frame is controllable by varying the ratio of the pressures of the hydraulic fluid applied to said hydraulic ram means and to said at least one hydraulic ram, wherein a first control unit is operated to vary the pressure of hydraulic fluid applied to said hydraulic ram means, and wherein a second control unit is operated to control the pressure of hydraulic fluid applied to each of said at least one hydraulic ram.

2. A method according to claim 1, wherein, prior to the advance of the frame, the elongate implements are advanced by said hydraulic rams.

3. A method according to claim 2, wherein, after the advance of the elongate implements but prior to the advance of the frame, each of said at least one hydraulic ram is braced outwardly into firm contact with the tunnel wall.

4. A method according to claim 1, wherein hydraulic fluid is applied to each ram of each of two groups of said hydraulic rams.

5. A method according to claim 4, wherein said two groups of rams are positioned symmetrically with respect to that plane of symmetry of the shield which passes through the centre of said hydraulic ram means and wherein said two groups of rams are positioned on the opposite side of the plane of symmetry of the shield that is at right-angles to said first-mentioned plane of symmetry, to said hydraulic ram means.

6. A method according to claim 1, wherein the second control unit is operated to apply hydraulic fluid at a constant pressure to each of said at least one hydraulic ram, and the first control unit is operated to vary the pressure of hydraulic fluid applied to said hydraulic ram means.

7. Apparatus for controlling the advance of a tunnel drive shield of the type having a plurality of elongate implements each of which is supported and guided on a frame, the elongate implements being movable relative to the frame by means of hydraulic rams, the apparatus comprising hydraulic ram means acting, in use, between the frame and a fixed tunnel lining positioned behind the drive shield, and means for varying the pressure of hydraulic fluid applied to said hydraulic ram means whereby the frame is advancable by applying hydraulic fluid to said hydraulic ram means and by simultaneously applying hydraulic fluid to at least one of said hydraulic rams, the direction of advance of the frame being controllable by varying the ratio of the pressures of the hydraulic fluid applied to said hydraulic ram means and to said at least one hydraulic ram, wherein a first control unit constitutes the means for varying the pressure of hydraulic fluid applied to said hydraulic ram means and wherein a second control unit controls the pressure of hydraulic fluid applied to each of said at least one hydraulic ram.

8. Apparatus according to claim 7, wherein said hydraulic ram means is constituted by a plurality of hydraulic rams.

9. Apparatus according to claim 8, wherein each of the rams constituting said hydraulic ram means is provided with a pressure relief valve whereby the hydraulic fluid may be applied to each of said rams at a different pressure.

10. Apparatus according to claim 9, wherein the first control unit is provided with a respective pressure-regulating valve for each of the hydraulic rams constituting said hydraulic ram means, the pressure-regulating valves being pre-set so as to apply hydraulic fluid at the same pressure to each of the pressure-relief valves associated with said hydraulic rams of said hydraulic means.

11. Apparatus according to claim 7, wherein the second control unit is such that a constant pressure is applied to said at least one hydraulic ram.

12. Apparatus according to claim 11, wherein the second control unit is provided with a pressure-regulating valve pre-set to apply the same pressure to each of said at least one hydraulic ram.

13. A drive shield for use in tunnelling, the drive shield comprising a plurality of elongate implements each of which is supported and guided on a frame, the elongate implements being movable relative to the frame by means of hydraulic rams, and apparatus for controlling the advance of the shield, said apparatus comprising hydraulic ram means acting, in use, between the frame and a fixed tunnel lining positioned behind the drive shield, and means for varying the pressure of hydraulic fluid applied to said hydraulic ram means whereby the frame is advancable by applying hydraulic fluid to said hydraulic ram means and by simultaneously applying hydraulic fluid to at least one of said hydraulic rams, the direction of advance of the frame being controllable by varying the ratio of the pressures of the hydraulic fluid applied to said hydraulic ram means and to said at least one hydraulic ram, wherein a first control unit constitutes the means for varying the pressure of hydraulic fluid applied to said hydraulic ram means, and wherein a second control unit controls the pressure of hydraulic fluid applied to each of said at least one hydraulic ram.

14. A drive shield according to claim 13, wherein said hydraulic ram means is positioned at the bottom of the shield.

15. A drive shield according to claim 15, wherein said hydraulic ram means is constituted by a plurality of hydraulic rams.

16. A drive shield according to claim 15, wherein each of the rams constituting said hydraulic ram means is provided with a pressure relief valve whereby the hydraulic fluid may be applied to each of said rams at a different pressure.

17. A drive shield according to claim 15, wherein the first control unit is provided with a respective pressure-regulating valve for each of the hydraulic rams constituting said hydraulic ram means, the pressure-regulating valves being pre-set so as to apply hydraulic fluid at the same pressure to each of the pressure-relief valves associated with said hydraulic rams of said hydraulic ram means.

18. A drive shield according to claim 15, wherein there are provided two second control units each of which controls the pressure of hydraulic fluid applied to a respective group of said hydraulic rams, said groups being positioned symmetrically about the longitudinal plane of symmetry of the shield and above the horizontal plane of symmetry of the shield.

19. A drive shield according to claim 15, wherein each of the elongate implements is associated with a respective one of said hydraulic rams.

20. A drive shield according to claim 19, wherein each elongate implement associated with each of said at least one hydraulic ram is provided with a device for bracing that elongate implement outwardly into firm contact with the tunnel wall.

21. A drive shield according to claim 15, wherein said hydraulic ram means acts between a floor pan which forms part of the frame and said tunnel lining.

22. In a tunnel drive shield of the type having a pluraltiy of elongate implements each of which is supported and guided on a frame, the elongate implements being movable relative to the frame by means of hydraulic rams, the improvement comprising providing hydraulic ram means acting, in use, between the frame and a fixed tunnel lining positioned behind the drive shield, and providing means for varying the pressure of hydraulic fluid applied to said hydraulic ram means whereby the frame is advancable by applying hydraulic fluid to said hydraulic ram means and by simultaneously applying hydraulic fluid to at least one of said hydraulic rams, the direction of advance of the frame being controllable by varying the ratio of the pressures of the hydraulic fluid applied to said hydraulic ram means and to said at least one hydraulic ram, wherein a first control unit constitutes the means for varying the pressure of hydraulic fluid applied to said hydraulic ram means, and wherein a second control unit controls the pressure of hydraulic fluid applied to each of said at least one hydraulic ram.

* * * * *